US005764917A

United States Patent [19]

Royer et al.

[11] Patent Number: 5,764,917

[45] Date of Patent: Jun. 9, 1998

[54] PROFESSIONAL SYSTEM FOR SWITCHING AND BIDIRECTIONAL TRANSMISSION WITH TIME MULTIPLEXING FOR HIGH-FIDELITY AUDIO-ANALOG AND AUDIO-DIGITAL SIGNALS AND CONTROL AND CHECKING SIGNALS

[75] Inventors: Christian Royer, Le Bono; Philippe Royer, Arradon, both of France

[73] Assignee: Innova Son, S.A.R.L., Ploeren, France

[21] Appl. No.: 624,599

[22] PCT Filed: Oct. 17, 1994

[86] PCT No.: PCT/FR94/01199

§ 371 Date: May 16, 1996

§ 102(e) Date: May 16, 1996

[87] PCT Pub. No.: WO95/11553

PCT Pub. Date: Apr. 27, 1995

[30] Foreign Application Priority Data

Oct. 18, 1993 [FR] France ..... 93 12364

[51] Int. Cl.[6] ..... G08C 15/00

[52] U.S. Cl. ..... 395/200.61; 370/360

[58] Field of Search ..... 381/2, 14, 80, 381/81; 395/200.17, 871, 200.61, 200.66; 370/360, 389; 704/200, 201

[56] References Cited

U.S. PATENT DOCUMENTS 3,795,771 3/1974 Gundersen et al. ..... 370/242

4,922,536 5/1990 Hoque ..... 381/2

FOREIGN PATENT DOCUMENTS 0 310 456 4/1989 European Pat. Off. .

2 552 958 4/1985 France .

3 615 981 11/1987 Germany .

2 265 288 9/1993 United Kingdom .

WO 87/06404 10/1987 WIPO .

*Primary Examiner*—Emanuel Todd Voeltz

*Assistant Examiner*—Thomas Peeso

*Attorney, Agent, or Firm*—Young & Thompson

[57] ABSTRACT

A system for recording and broadcast studios for time multiplexed bidirectional transmission and switching high-fidelity audio-analog and audio-digital signals and command and control signals. A first bidirectional transmission medium conveys first frames produced by multiplexing the high-fidelity signals and command and control signals between a transmitter and a master receiver. The system also includes a controller with a man-machine interface (26, 32, 33, 34) receiving the high-fidelity signals transmitted by input circuits included in the transmitter and the command and control signals for monitoring in real time the evolution of the various parameters related to the signals, and for controlling in real time the modifications and configuration adaptions in the transmitter.

13 Claims, 9 Drawing Sheets

PROFESSIONAL SYSTEM FOR SWITCHING AND BIDIRECTIONAL TRANSMISSION WITH TIME MULTIPLEXING FOR HIGH-FIDELITY AUDIO-ANALOG AND AUDIO-DIGITAL SIGNALS AND CONTROL AND CHECKING SIGNALS

The present invention relates to a professional system for switching a bidirectional transmission with time multiplexing for high-fidelity audio-analog and audio-digital signals and control and checking signals.

Devices for the transmission of digital signals, particularly audio-digital signals such as those produced and processed in recording studios, radio stages and control rooms for radio or television or concert halls have, in the case of certain uses, also a certain number of problems.

Nowadays, two types of transmission device are used, analog transmission systems and digital transmission systems. Analog transmission systems rely essentially on the principle of electric cabling from wire to wire. In -this case, each of the sources is individually connected to a housing which assembles in a single strand, called a multipair, all the wires from each source. This multipair is connected to a second housing which permits, by derivative cabling, routing and distributing the signals toward the different mixing control rooms. Finally, each control room has its own display panel (called a "patch") which permits it to organize its routing and posting of the signals. The return transmission of mixed or processed signals is effected by the same multipair whose wires will have been reserved for this purpose. Such arrangements have drawbacks by virtue of their weight and a very large volume of cable. Moreover, they require difficult and costly construction because of the high number of connectors and connections and because of the requirement to perform manual operations on the assembly of the network.

A second group of transmission systems is constituted by digital transmission systems. An example of such a system is described in U.S. Pat. No. 5,060,273. This system relies on the principle of digitized signal multiplexing. The sources are generally connected individually to one or several accumulation housings which assemble them in a multipair. This latter is connected to a transmitter housing which converts each signal by the bias of preamplification circuits. These circuits are remotely controlled from a master receiver by a specific connection. The digital signals multiplexed in series are transmitted in light form, through one or several optical fibers, and thus supply several control rooms simultaneously. The digital nature of the signal permits routing it by electronic control and memorizing different configurations. The remote control of the transmitter and the return of the signal in another direction takes place by a second optical fiber connection. Such a transmission device, whilst solving previous problems of analogous devices, namely by reduction of size and weight, nevertheless has other drawbacks such as, in particular, its cost, the fragility of the transmission device resulting from the fragility of the optical fibers and the impossibility of reconfiguring as desired the selected configuration so as to be able to vary the number of sources and the number of distribution channels.

Another device for the transmission of audio-digital signals is described in U.S. Pat. No. 4,922,536. In this device, a bidirectional transmission support sends the frames produced by multiplexing the high-fidelity signals between first end equipment for time switching and transmission of signals, called a transmitter, and second end equipment for time switching and transmission of signals, called a receiver.

On the other hand, there is disclosed no processing device for signals in particular by means of signals for controlling and checking the parameters of the high-fidelity signals so as to act in real time on the parameters of said signals.

The object of the present invention is therefore to provide a professional system for switching a bidirectional transmission with time multiplexing for high-fidelity signals and control and checking signals between a transmitter and a receiver, that is simple to use and of low cost, independently of the configurations of the transmitter and receiver.

Another object of the invention is to provide such a highly modulable device, the passage from one configuration to another being adapted to take place in real time without the intervention of a team of workers.

The invention provides for this purpose a professional system for switching and bidirectional transmission with at least time multiplexing for high-fidelity audio-analog and audio-digital signals and control and checking signals, such as those produced and processed in recording studios, radio and television and sound stages and control rooms, or concert halls, comprising a first bidirectional transmission support to convey first frames produced by multiplexing said high-fidelity signals and control and checking signals between a first end equipment for time switching and signal transmission, a so-called transmitter, and a second end equipment for time switching and transmission of signals, a so-called master receiver, characterized in that it also comprises control means with a human-machine interface receiving the high-fidelity signals transmitted by input circuits included in the first end and said control and checking signals to monitor in real time the change of various parameters relative to said signals and to control in real time the modification and adaptations of configuration in said first end equipment by means of said control and checking signals.

According to a preferred embodiment of the invention, said control means with a human-machine interface comprise parameter computation means with dynamic memory to compute for each of the high-fidelity signals first respective absolute values, means to memorize said absolute values, means to compare respectively said first absolute values with second absolute values previously memorized, and means to detect and memorize the absolute values of greatest magnitude from among the compared absolute values.

Furthermore, said control means with human-machine interface comprise data processing means connected to said parameter computation means with dynamic memory and with address control means included in said second equipment to process and display in real time different blocks of information, control and routing, corresponding respectively to transmission channels attributed in the respective system to said high-fidelity signals and to control in real time modification and adaptations of configuration in said first end equipment by means of said control and checking signals and this as a function of orders given by an operator particularly by means of a cursor such as a mouse.

Other characteristics and advantages of the invention will become apparent from a reading of the description of one embodiment and the accompanying drawings, in which.

Figure 1:
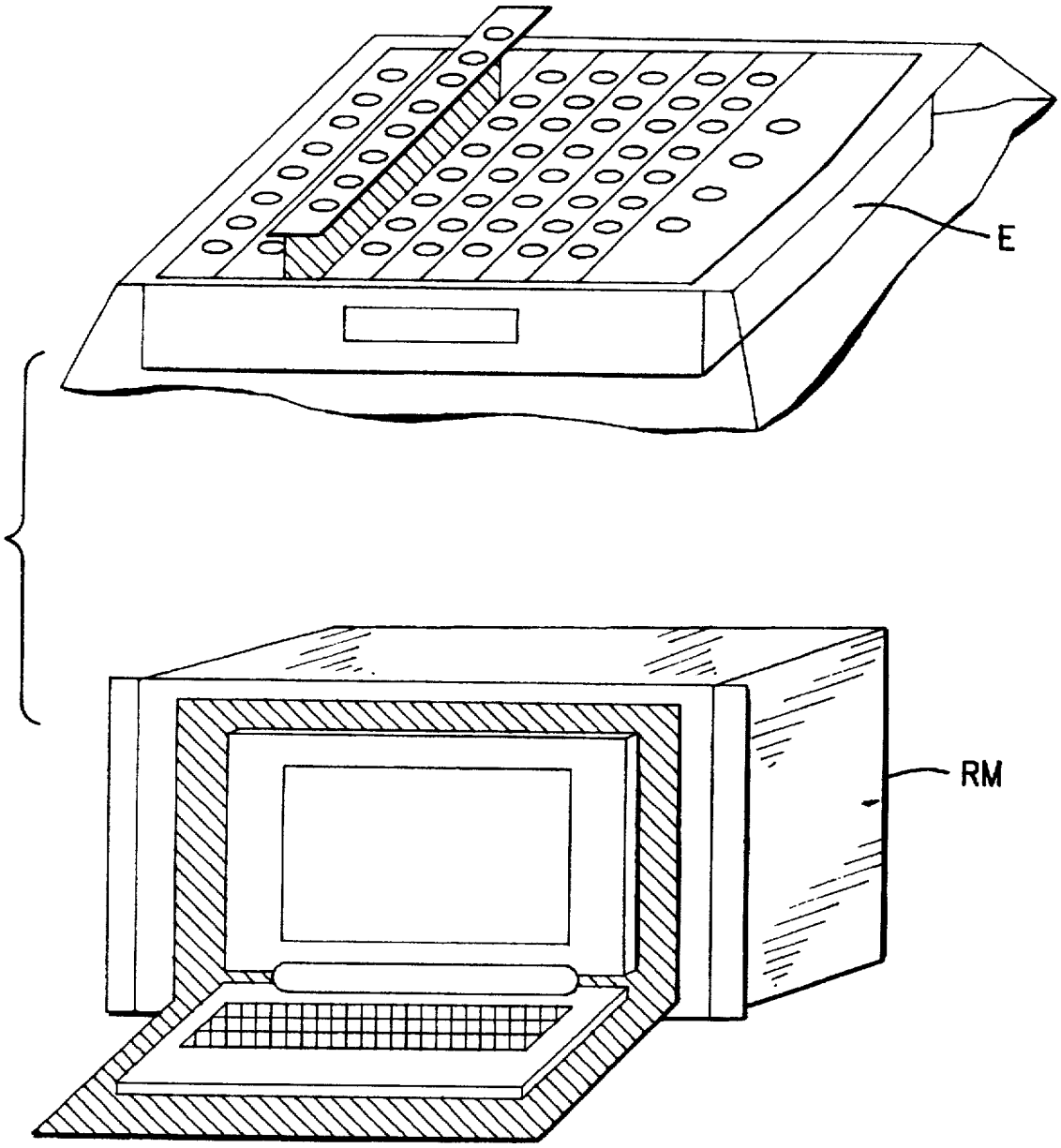
FIG. 1 is a perspective view of the transmitter and receiver including the data processing device.
Figure 2:
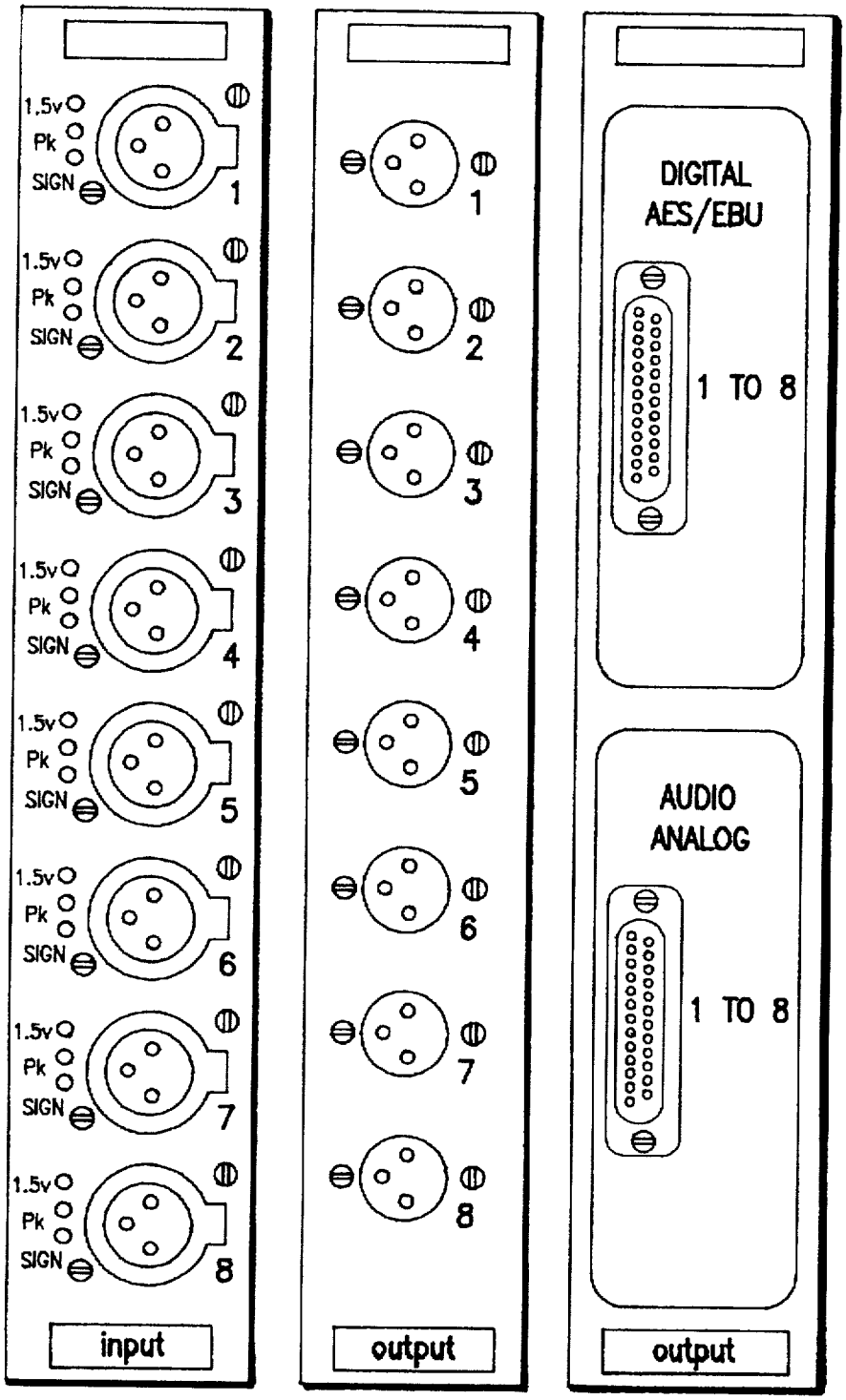
FIG. 2 is a schematic view of the standardized input and output modules of the transmitter and of the receiver.

The system for switching and bidirectional transmission of time multiplexed audio signals and control and checking signals according to the invention, comprises at least two units, one a so-called transmitter (E), the other a so-called master receiver (RM), interconnected by a bidirectional transmission member such as a cable. The transmitter (E), which constitutes a first end equipment for time transmission and signal transmission is present generally, as shown in FIG. 1, in the form of a housing comprising an electronic bus adapted to receive n modules. The n modules are constituted of a module charged by the electric supply of the housing, a checking module for transmission and n–2 modules each of which checks either at the input or at the output x analog or digital signals. The receiver (RM) has an analog configuration. It can comprise also an autonomous data processing system constituted for example by a portable microcomputer, connected to the checking module of transmission by a parallel connection 32. It is also possible to provide this device with a separate screen so as to increase the viewing comfort of the user. In practice, the transmitter (E) and the receiver (RM) could have an arrangement similar to that shown in FIG. 1. The input and output modules, as shown in FIG. 2, are each constituted by eight channels, with each channel having luminous signals for indicating the presence of the leveling signal and the presence of a phantom supply. In the example of such input and output modules shown in FIG. 2, the first module constitutes an input module, the two other modules constitute output modules whose connection is adapted as needed by the user. Thanks to this type of module, the emitter and the receiver having a corresponding configuration, it is possible to make the assembly modular so as to give the possibility of an infinite number of configurations. Thus, in a first configuration, it is possible to select eight input modules for the transmitter and eight output modules for the receiver. In this case, the configuration will comprise 64 source inputs and 64 source outputs.

In another configuration, it is possible to have at the transmitter, five input modules corresponding to 40 source inputs and three output modules corresponding to 24 mixed outputs. Similarly, in the receiver, there will be five output modules corresponding to 40 mixed outputs and three modules corresponding to 24 mixed inputs.

Figure 3:
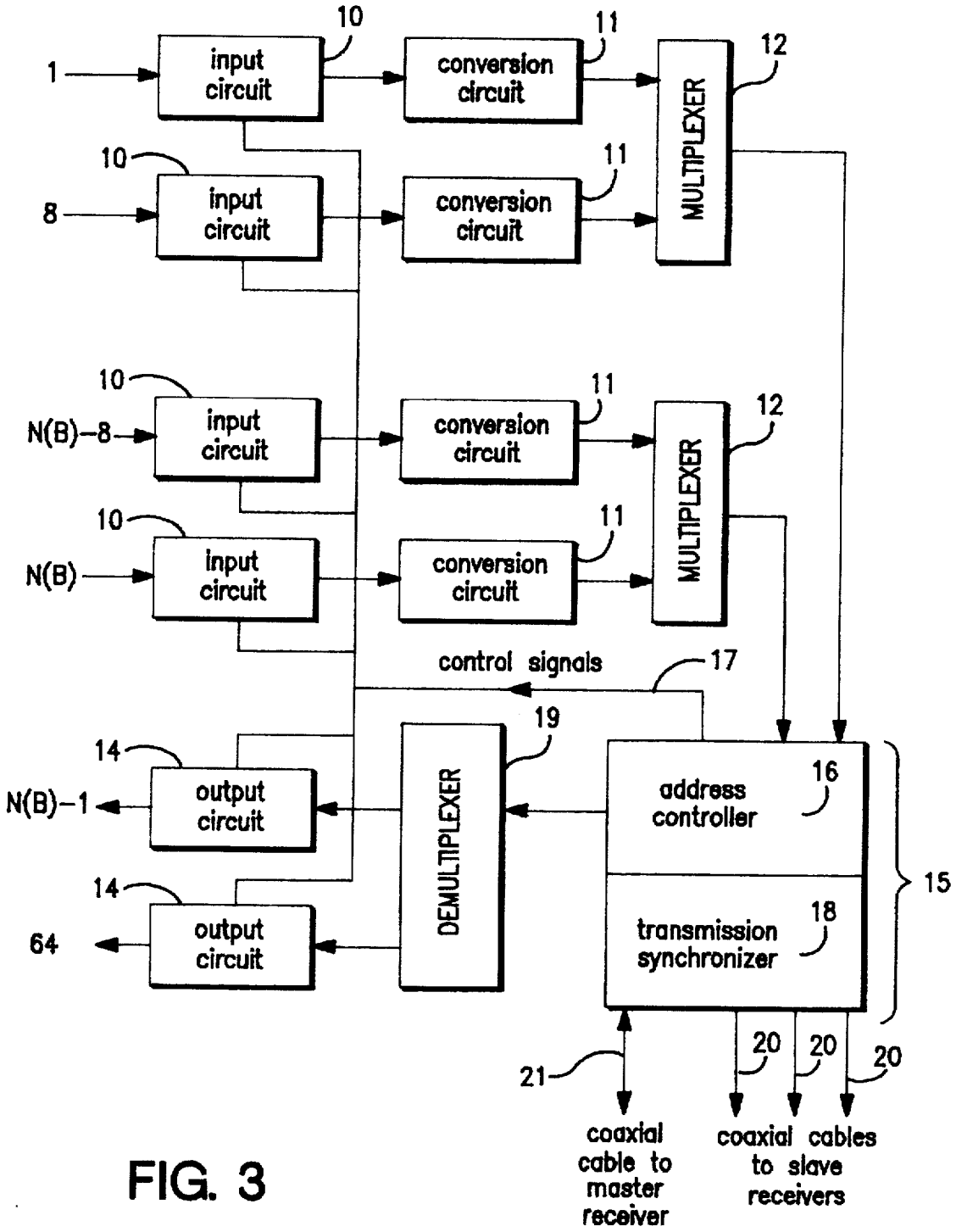
FIG. 3 is a synoptic view of the transmitter circuits.

In another configuration, it is also possible to have for the transmitter three input modules, namely 24 source inputs, one output module, namely eight mixed outputs and for the receiver, three output modules, namely 24 source outputs, one input module, namely eight mixed inputs and two input modules of the effect type so as to have 16 effect inputs and two output modules to have 16 effect outputs. From a physical standpoint, the embodiment of the transmitter and the receiver will be seen therefore to be quite simple and reliable whilst offering a large number of possibilities. Obviously, it will be noted that it is possible to connect several receivers to the same transmitter as shown in FIG. 3. The operation of such a configuration will be described hereafter.

Figure 4:
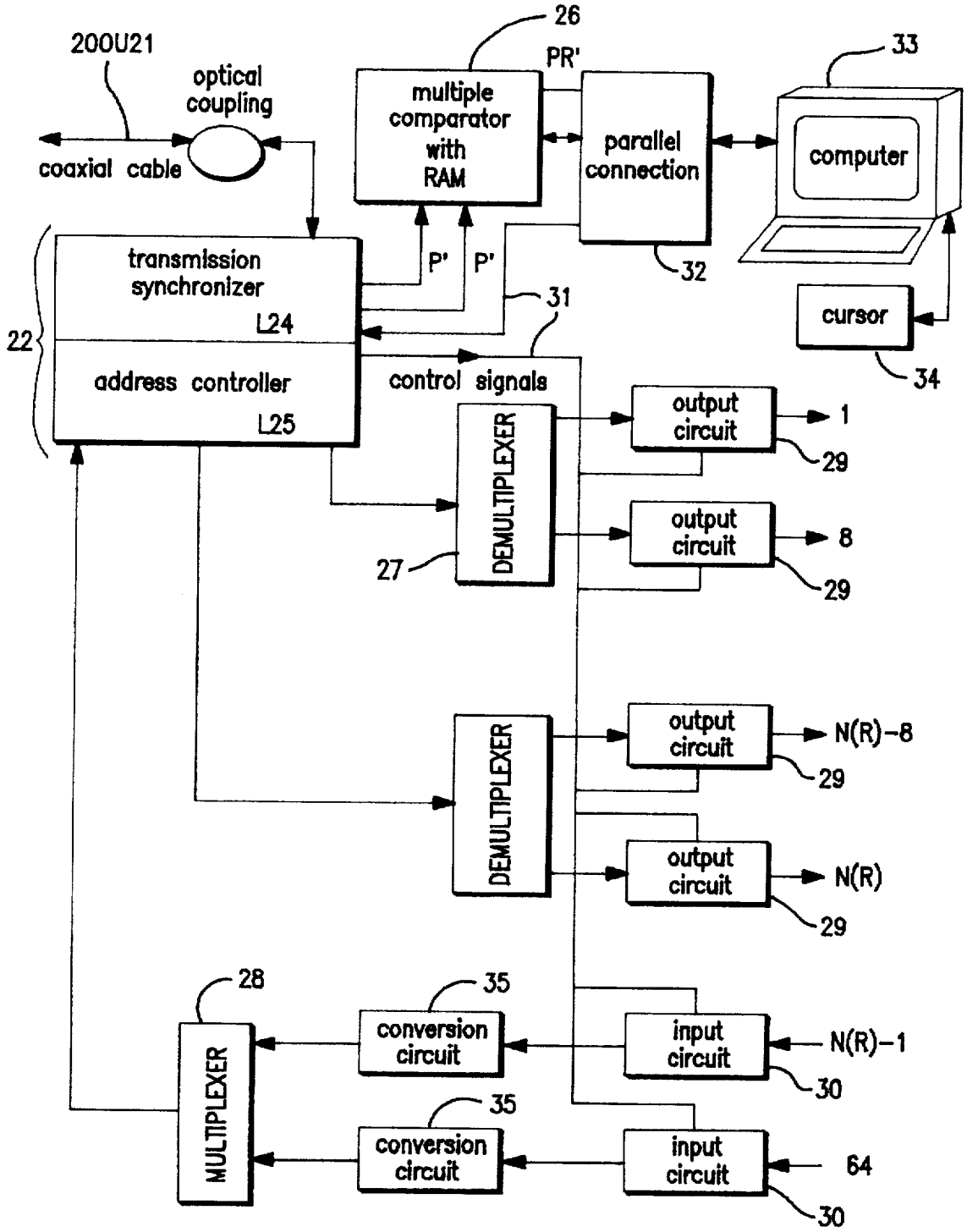
FIG. 4 is a synoptic view of the receiver circuits.

The signals entering the transmitter from input circuits represented in FIG. 3 follow a path described hereinafter. The audio-analog signals and/or audio-digital signals from various sonic sources are brought by means of suitable cables to the input modules of the transmitter and are connected to this latter. The connection is shown by the block 10 labeled input circuit. Then in the case of audio-analog signals, these audio-analog signals are either multiplexed then converted and again multiplexed, or directly converted by means of an analog digital converter known per se shown at 11 in FIG. 3, then multiplexed by means of digital multiplexing devices 12 also known per se. For purposes of simplification, for eight input circuits corresponding to one input module, will correspond to one digital multiplexing circuit 12. Thus, in the example shown in FIG. 4, the most that can be sent, to the address checker 16, will be eight different audio-digital signals. According to the number of input circuits and hence of input modules, which will have been used, there will be a number of output circuits corresponding to eight less the number of input modules. These output circuits have for their purpose to direct generally audio-analog signals toward different elements such as amplifiers of loud speakers, magnetophones, etc., and more generally to any device adapted to process said signals. The audio-analog input signals, once converted and multiplexed, are introduced into a device 15 called a device for checking transmission which comprises two blocks, namely an address controller 16 and a transmission synchronizer 18. As shown in FIG. 4, the receiver (R) comprises, in a manner analogous to the transmitter, input circuits shown at 30, conversion circuits shown at 35 and multiplexing circuits shown at 28, a transmission synchronizer 24 and an address checker 25 forming an integral portion of the transmission checking device 22. The output circuits corresponding to the output module are connected to the address checker by a demultiplexing system 19 for the transmitter and 27 for the receiver portion. These portions of the circuit are adapted to receive signals from the transmitter or receiver respectively, so as to send them to the output circuits and toward various elements such as the mixing table or peripherals for the receiver elements. The transmission of data frames thus produced by multiplexing the high frequency signals between the transmitter (E) and the master receiver (RM) takes place by means of a bidirectional transmission support 21 which can be constituted by a coaxial cable of conventional type of the type adapted for transmission checkers 15 and 22.

As shown in FIG. 4, in addition to high-fidelity signals, control and checking signals can be transmitted between the transmitter and the receiver, these signals permitting controlling in real time the modifications and adaptations of configuration 17 in the transmitter (E). These control and checking signals come from a control device with a human-machine interface comprising a multiple comparator with dynamic memory 26 receiving the high-fidelity signals transmitted by the input circuits included in the first end equipment E, data processing means 32, 33, 34 of the values calculated in the multiple comparator 26, said data processing means being also connected to address control means 31 included in the receiver. Thanks to such a device, it becomes possible to process and visualize in real time different control and routing blocks of data corresponding respectively to the transmission channels (channels 1–64) assigned by the system to the high-fidelity signals and for controlling in real time the modifications and adaptations of the configuration in said first end equipment E by means of said control and checking signals, this as a function of orders given by an operator, particularly by means of a cursor such as a mouse 34. To obtain such a direction of signals, it is necessary to check in a synchronous manner the bidirectional transmission of the signals between the transmitter and the receiver. These are the address checkers 16 and 25 and the transmission synchronizers 18 and 24 respectively of the transmitter and of the receiver which control this transmission. Thus, the address checker 16 of the transmitter has for its purpose to assign to the input audio circuits 10 and output audio circuits 14 of the transmitter, the control signal 17 of their parameters, to assign the audio-digital signals of the input multiplexers 12 to the transmission synchronizer 18 and/or to the demultiplexers 19 of the output circuit 14, and to send the audio-digital signals of the synchronizer 18 to said output multiplexer 19. As to the transmitter synchronizer, it concatenates the multiplexing of the audio-digital signals according to a process such as the process 2B3Q, it emits into the transmission member such as a coaxial cable the frame 2B3Q, it deconcatenates and transmits to the address checker 16 the audio-digital signals and the control signals from the master receiver via the transmission member such as the cable 21. Similarly, the transmission synchronizer 24 of the receiver deconcatenates and transmits to the address checker 25 of the receiver the audio-digital signals from the transmitter via the transmission support member 21; it transmits to the multiple comparator 26 the assembly of the audio-digital signals from the cable; it concatenates the multiplexing of the audio-digital signals and telecontrol signals from the address checker 25 according to a process such as the process 2B3Q; it emits into the transmission support member 21 the frame 2B3Q. As to the address checker 25 of the master receiver, it directs the audio-digital signals of the synchronizer 24 to said output multiplexers 27; it directs the audio-digital signals of the input multiplexers 28 to the transmission synchronizer 24 and/or to multiplexers 27 of the output circuit 29; it receives from the parallel connection 32 the control signals 31 of the parameters of the input audio circuits 10 and output audio circuits 14 of the transmitter when it transmits to the transmission synchronizer 24; it receives from the parallel connection 32 the control signals 31 of the parameters of the input and output circuits 29 and directs them; it transmits to the multiple comparator 26 the audio-digital signals from the input circuits 30 and the output circuits 29 which would not be transmitted the transmission synchronizer 24. Thus, such a bidirectional transmission of such a quantity of data is possible thanks to the fact that said end equipment E, RM, RE comprises processors 3 and extractors 13 of the 2B3Q type to carry out the concatenation and deconcatenation operations respectively after multiplexing and before demultiplexing of the multiplexed frames, and in that the value z is assigned as an initial value to be fixed in said processors 3 and extractors 13. Thus, the processors 2B3Q carry out the combination of the different states of the data coming from them in foursomes of which one is the value zero volt, value at which the address circuits force the output of the transmission multiplexers thereby placing the transmission line in receiving mode. To obtain such a result, it is possible to use circuits according to FIGS. 6 and 7. In these circuits, it will be noted that it is preferable to provide on the receiver side, optical coupling means 23 disposed at different levels over the range of the signals and frames to guarantee correct galvanic insulation between said end equipment and to avoid all the ground loop. It will also be noted that the clocks and synchronization circuits of the receivers are subjected to phase locking loops for a single time reference. Once the problem of bidirectional transmission in real time of the data is solved, it is further suitable to control the problem of processing in real time of a plurality of signals. This problem is solved thanks to the control means with a human-machine interface. These control means are particularly constituted by a multicomparator with a dynamic memory 26 which comprises means **26*a* to compute the parameter with dynamic memorization to calculate for each of the high-fidelity signals first respective absolute values, means 26*b* to memorize said absolute values, means 26*c* to compare respectively said first absolute values with second absolute values previously memorized, and means 26*d*** to detect and memorize the absolute values of greater magnitude among the compared absolute values.

Figure 9:
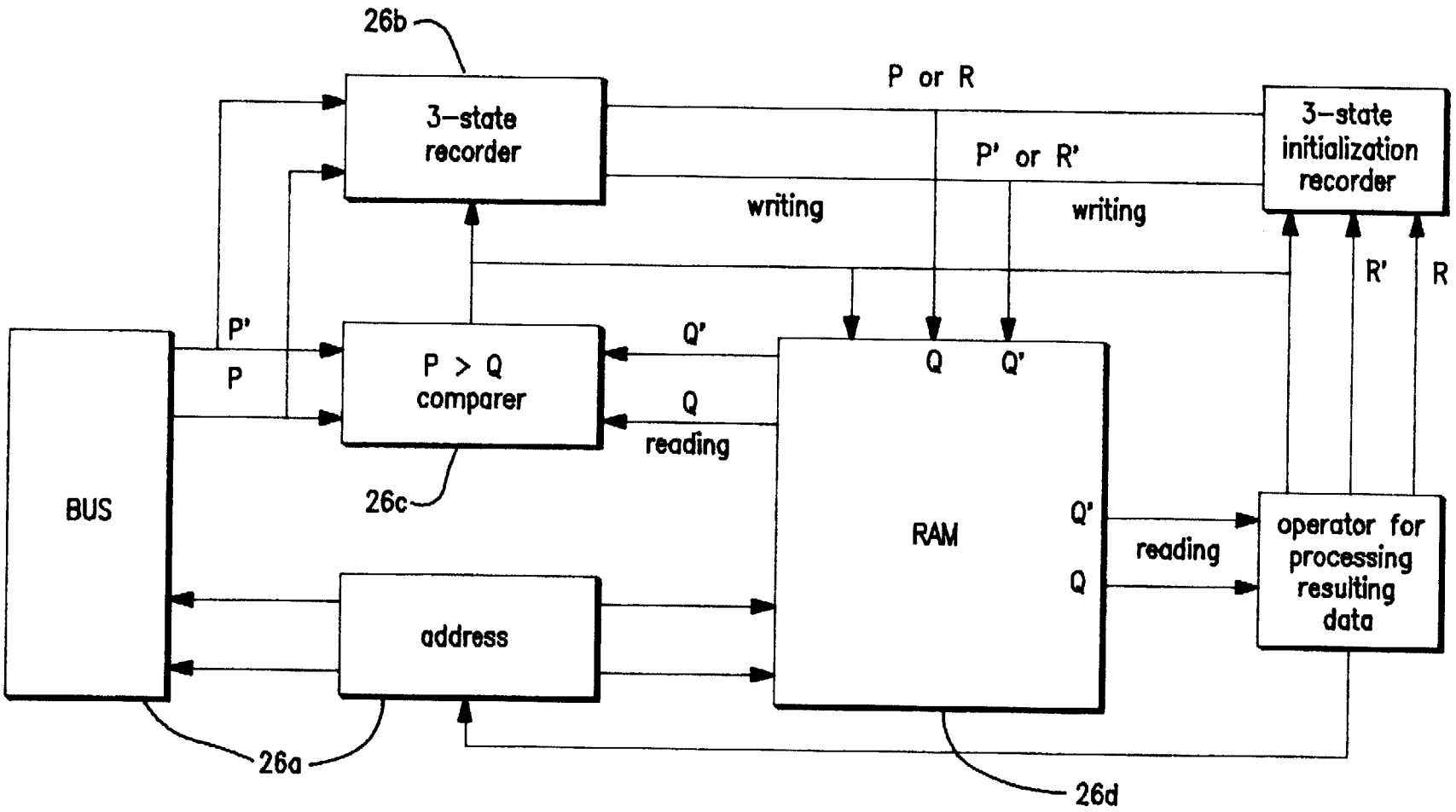
FIG. 9 is a circuit diagram of a data multiple comparator, with dynamic memory.

An example of a circuit of this multiple comparator is shown in FIG. 9. In this case, the device is constituted preferable by the following elements:

- a data bus cadenced by an address bus permitting the device to access the data to be processed;
- a logic comparator (example: 74HC681), if desired associated with any type of computer;
- two logic recorders with three conditions (example: 74HC374);
- a random-access memory (example: RAM 6264);
- any kind of logical operator requiring the result of the comparison (example: IBM PC).

The operation of such a device shown in FIG. 9 is as follows.

The operator defines the initial reference data R to R' which are transmitted to the recorder.

The comparator receives from the bus the data P to P' and from the RAM 3 the data Q to Q' whose respective addresses are defined by the address bus. The recorder receives simultaneously from the bus the data P to P'.

The comparator emits one control pulse which:

- places the recorder in the third state and, according to the result of comparison:
  - either authorizes the recorder to erase the data P to P' and, simultaneously places the RAM in "writing" mode, which has the effect of replacing the data Q to Q', until now present in the memory, by the data P to P' which become because of this fact the new data Q to Q';
  - either blocks the data P to P' present in the recorder and authorizes this latter to maintain itself. On the other hand, the RAM is placed in the "read" mode and permits because of this a new comparison operation.

To the extent the condition of the comparator is not found, the RAM, being in the reading mode, sends to the user data Q to Q' so that he will perform the possible processing thereof. The periodicity and length of the keyboarding of the data by the operator can be easily defined.

However, so as to refresh the data Q to Q' in the RAM 3 and to retrieve therefrom initial reference values R to R', the user, by a control pulse, requires the recorder to assume a third condition, places the RAM in "write" mode and frees the data from the recorder toward the RAM; he can, because of this, place in the RAM predefined data R to R', and this simultaneously for all the addresses.

In other words, the multiple comparator with dynamic memory 26 receives from the synchronizer 24 and from the checker 25 digital signals and, for each signal, calculates therefrom the absolute value, compares this value with the preceding memorized value and memorizes the larger value. These operations take place for each signal and simultaneously for all. Afterwards, it supplies to the parallel connection 32 and at its demand the last values memorized and receives periodically an order to reset to zero all these values. The parallel connection 32 thus then insures the exchange with the computer equipment 33 provided with appropriate software from the assembly of data from the multiple comparator 26 and the assembly of the data from the computer 33. The user, given the displayed data, translates the data from the computer 33 into control signals adapted to set the parameters of the input circuits 10 and output circuits 14 of the transmitter and the output circuits 29 and input circuits 30 of the master receiver. To do this, it transmits its control signals to the controller 25.

Thanks to this processing device, for each channel, it is possible from the keyboard of the computer to modify, for example, the gain, the phantom feed (48 volts for each channel), to modify the parameters such as the phase inversion, channel cutting, gain, label, choice of input channel, etc. Because of this, it is possible to act on each channel without physical intervention, the transmission of information and the execution of the order taking place substantially in real time.

Figure 5:
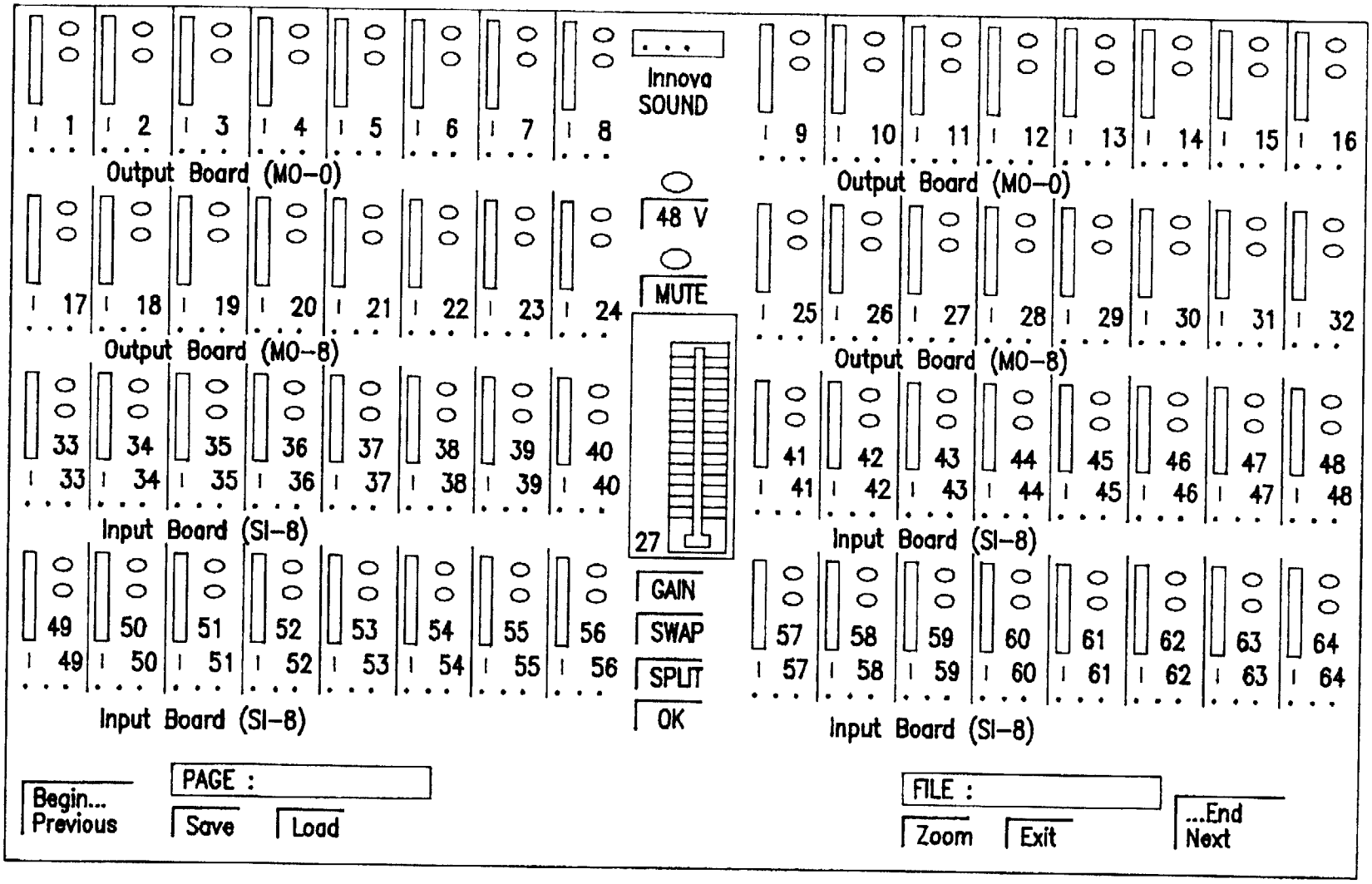
FIG. 5 is a screen picture of the computer permitting visualization of all the channels.

To optimize such a processing device, one could, for example, choose to present the channels to the screen in the form of an analog diagram of FIG. 5. In this case, each channel is displayed in the form of a volume-unit meter, a label, its input channel, its output channel, the presence of phantom supply and cutting of the channel. To act on one of the channels, at least one suitable pointer device is selected (mouse, ball, cursor) the channel that has to be modified and the selected parameter is modified. Of course, it is possible by means of suitable software to integrate the functions known per se such as the functions of safeguarding, loading, etc.

Figure 6:
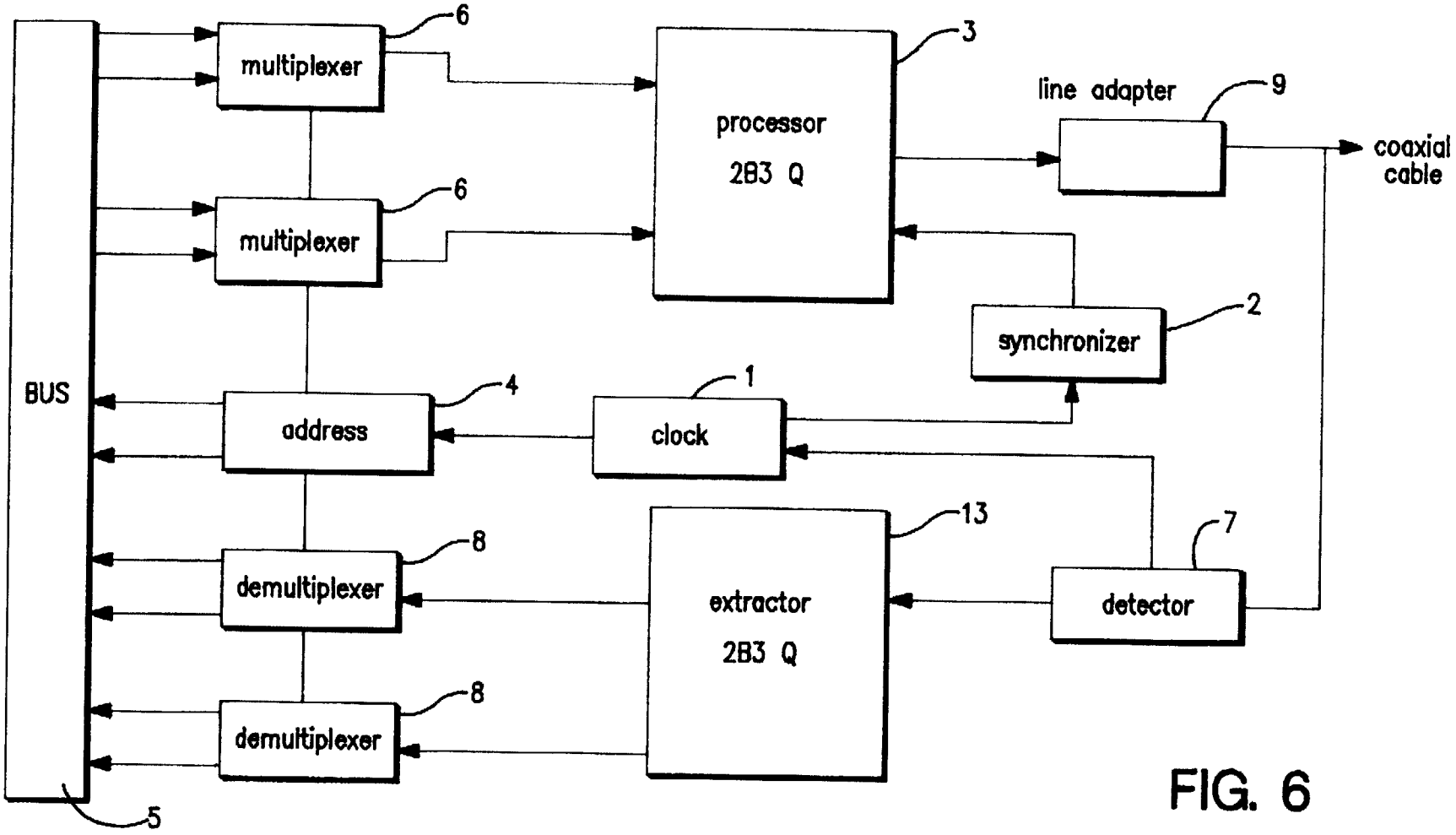
FIGS. 6 and 7 show respectively a schematic view of the circuits of the transmitter and of the receiver permitting transmitting, at a high speed in a bidirectional manner, the digital data.
Figure 7:
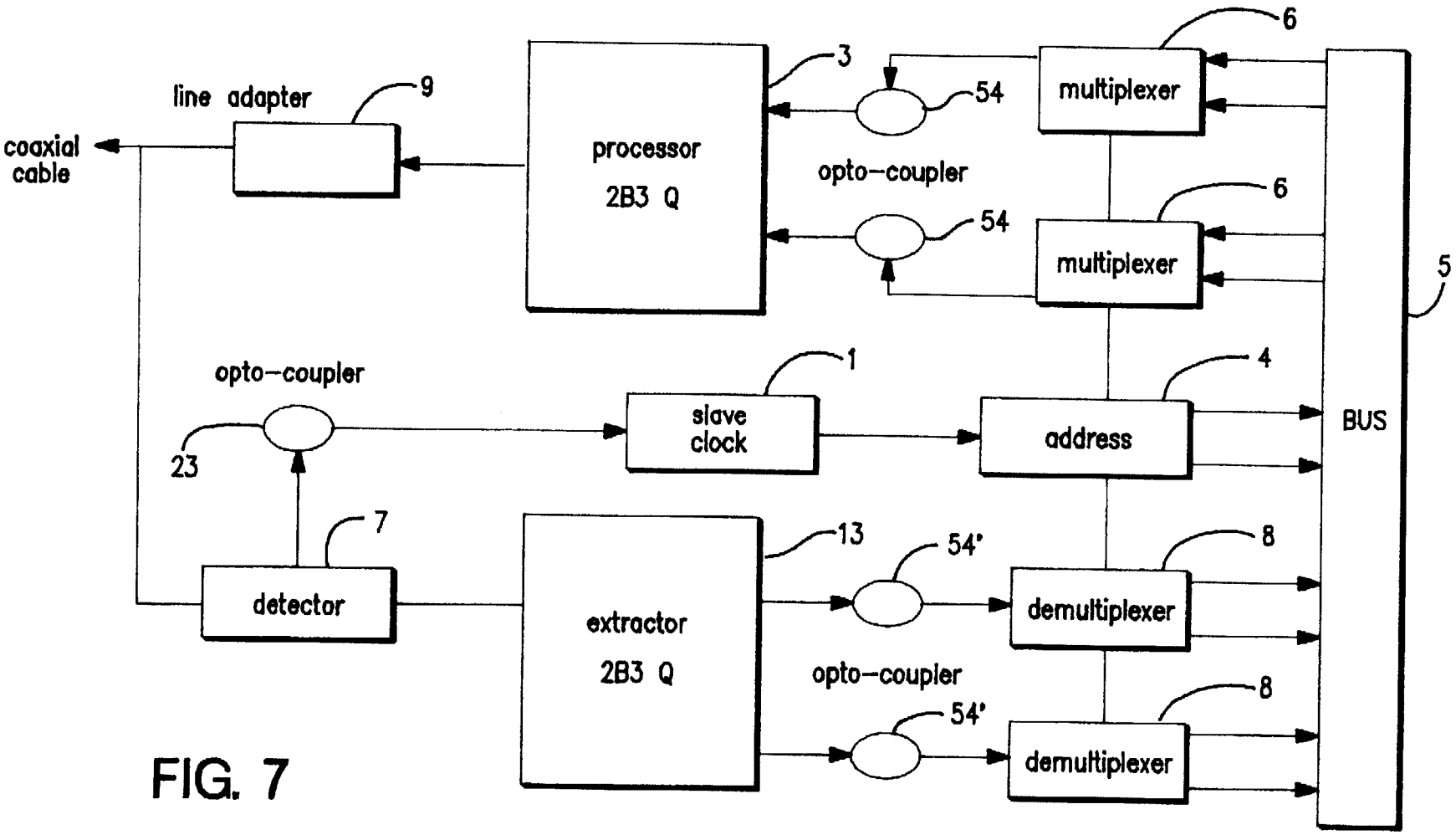

As was pointed out above, the device is constituted for each site by a circuit comprising a portion dedicated to transmission of data (FIG. 6), the other to the reception of data (FIG. 7). One of the two sites is defined as the master and, because of this, generates the time reference. This master is conventionally called the transmitter, the other being the receiver. As was said above, the transmitter is preferably constituted by the following elements: a parallel bidirectional data bus of the microprocessor type cadenced by an address bus 4 permitting the device to access the data of each channel to be transmitted, a clock circuit 1 insuring the cadencing of the device, one or several logical multiplexing circuits 6, a synchronization circuit 2 defining the time reference and the frequency of sampling, a concatenation circuit 3 for data of the type 2B3Q and of adaptation of impedance of the cable 9 and a reception detection circuit 7, a deconcatenation circuit 13 of frame 2B3Q, a demultiplexing circuit 8 of data, a device for access to the data and address bus. The receiver is constituted of the same elements as those of the transmitter. However, the clock device insuring the cadencing and the address of the data is subjected to the time reference of the transmitter transmitted by the cable.

Figure 8:
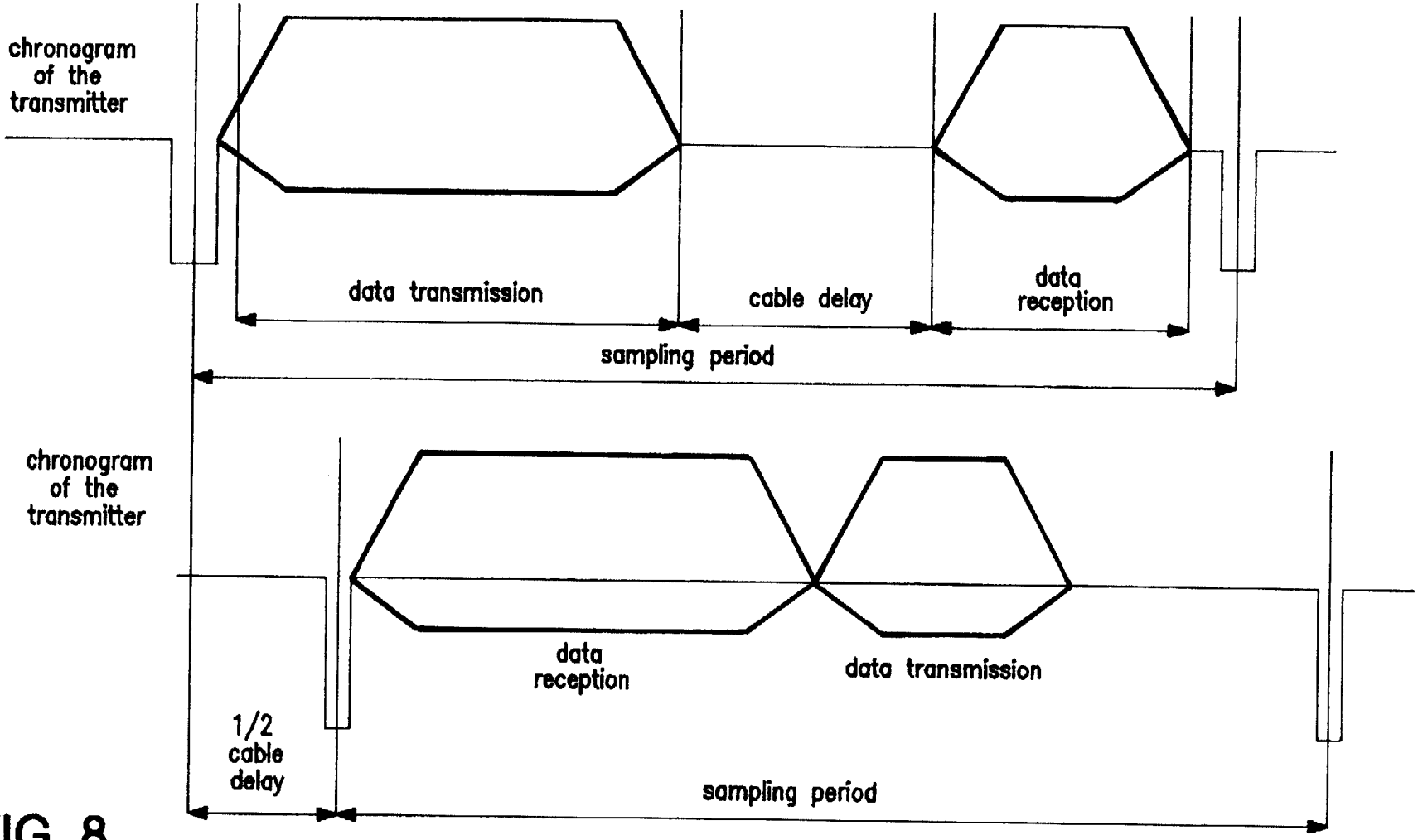
FIG. 8 shows time diagrams of the transmitter and receiver in the case of the circuits according to FIGS. 6 and 7.

Thus, in the transmission phase, as shown in FIG. 6, the signals follow the following scheme:

- the clock circuit 1 emits to the synchronization circuit 2 the time reference which defines the sampling period. The synchronization circuit 2 then creates a pulse which it transmits to the processor 3;
- the clock 1 also cadences the address circuit 4 which determines the travel of the data to be emitted, from the bus 5 to the multiplexers 6;
- the multiplexing circuits produce the data to be sent to the processor 3 by serializing them, according to the orders of the address circuit 4; there is shown the different possible states of the serialized data in FIG. 8 (data 1 and 2);
- the processor 3 combines the data according to a process 2B3Q which can produce a condition diagram such as that of FIG. 8. It then emits, according to the time chart of FIG. 8, toward the line adaptor 9, the time reference of the circuit 2 and the processed data;
- after transmission of the last datum, the address circuit forces the logic state of the outputs of the multiplexers to the values of the case 1 of FIG. 8, thus placing the transmission line in a reception mode;
- the adaptor 9 supplies the energy necessary to the transmission and guarantees the adaptation of impedance.

Finally, in the reception phase, as shown in FIG. 6, the signals follow the following scheme:

- after a delay proportional to the length of the cable, the circuit 7 detecting the arrival of reception signals, transmits a pulse to the clock circuit 1, which restarts the cadencing of the address circuit 4;
- the processor 13 effects the extraction of the data from the coding 2B3Q effected in the receiver and transmits them in series to the demultiplexers 8;
- the demultiplexers 8 convert the series data into parallel data which they transmit on the bus 5;
- the address circuit 4 determines the path of the data received by the transmission in the demultiplexers 8 and the bus 5.

Conversely, the receiver behaves according to FIG. 7. Thus, in the course of the reception phase:

- the detector 7, receiving the data from the transmitter, transmits via an optical coupling circuit 54, the time reference to the clock circuit 1;
- clock 1 is controlled by the time reference via a phase locking loop and transmits to the address circuit 4 the synchronization signal;
- the circuit 13 extracts the data of the coding 2B3Q transmitted by the transmitter and transmits the data in series to the demultiplexers 8 via the optical coupling 54;
- the demultiplexers 8 transmit the data, in their original format, to the bus according to the addresses of the controller 4.

Finally, in the course of the transmission phase:

- the address circuit 4 having addressed the data received from the transmission, addresses, by the bus 5, toward the multiplexer 6 the data to be transmitted toward the transmitter;
- the optical coupling circuits 54 insure the connection of the data in series between the multiplexers 6 and the processor 3;
- the process for emission of the data takes place in the same manner as in the transmitter.

Because of this, there is obtained a bidirectional transmission controller of digital data in a coaxial cable of at least 300 meters with a speed permitting the exchange of at least 80 megabits per second. Because of this, the users can react at the speed of reflex.

According to a preferred embodiment of the invention shown in FIG. 5, the system also comprises a plurality of second annexed equipment for time switching and for signal transmission, so-called slave receivers RE, and a plurality of second transmission supports 20, said plurality of second annexed equipment RE being connected to said first equipment E respectively via said plurality of second transmission supports 20, and said transmission supports 20 conveying unidirectionally second multiplexed frames in the direction of the first equipment E through the second annexed equipment RE. Moreover, said control means with human-machine interface 26, 32, 33, 34 are included in said second equipment for time switching and signal transmission RM, and said second equipment RM is located in a mixing control room and said second annexed equipment RE is located in recording or broadcast control rooms. As the master receiver, slave receivers can have a modular architecture and comprise different standardized modules (input, output, control, supply) contained in the channels.

We claim:

1. A system for bidirectional switching and time multiplexed transmission of high-fidelity audio-analog and audio-digital signals and control and checking signals, comprising:

a transmitter and a receiver for exchanging first frames of said time multiplexed high-fidelity signals and control and checking signals; and control means with a human-machine interface (26, 32, 33, 34) for receiving the high-fidelity signals and said control and checking signals to monitor in real time the changes of various parameters relative to said high fidelity signals and to control in real time the modifications and adaptations of configuration of said transmitter by means of said control and checking signals.

2. The system according to claim 1, wherein said control means comprises computing means (26*a*) with dynamic memorization to compute for each of the high-fidelity signals first respective absolute values, means (26*b*) to memorize said absolute values, means (26*c*) to compare respectively said first absolute values to second absolute values previously memorized, and means (26*d*) to detect and memorize the absolute values of largest magnitude from among the compared absolute values.

3. The system according to claim 2, wherein said control means comprises data processing means (32, 33, 34) connected to said computing means and to said receiver to process and display in real time control and routing data blocks corresponding respectively to transmission channels in the system devoted respectively to said high-fidelity signals, and to control in real time modifications and adaptations of configuration of said transmitter as a function of the orders given by an operator.

4. The system according to claim 1, wherein said transmitter and receiver comprise processors (3) and extractors (13) of the 2B3Q type to effect concatenation and deconcatenation operations respectively after multiplexing and before demultiplexing the multiplexed frames, and wherein a value zero is an initial value in said processors (3) and extractors (13).

5. The system according to claim 1, further comprising a plurality of slave receptors with time switching and signal transmission, said slave receptors being connected to said transmitter and receiving multiplexed second frames from said transmitter.

6. The system according to claim 5, wherein said control means with human-machine interface (26, 32, 33, 34) are included in said receiver, and said receiver is located in a mixing control room and said slave receptors are located in at least one of recording and broadcasting control rooms.

7. The system according to claim 1, wherein said transmitter is connected to said receiver and to said slave receptor with coaxial cable.

8. The system according to claim 1, wherein said transmitter and receiver comprise a modular architecture and comprises different standardized modules disposed in channels.

9. The system according to claim 1, further comprising optical couplers (23, 14) disposed at different levels about the signals and frames to guarantee correct galvanic insulation between said receiver and transmitter.

10. A system for bidirectionally switching and time-multiplexed transmission of high-fidelity audio signals and control signals, comprising:

a transmitter and receiver for exchanging time-multiplexed high-fidelity audio signals and control signals; and control means for receiving the high-fidelity signals and for receiving the control signals to monitor in real time changes in parameters related to the high-fidelity signals and to control in real time a configuration of said transmitter by means of said control signals, said control means comprising computer means for computing and storing a first absolute value related to the high-fidelity signals, for computing a subsequent second absolute value related to the high-fidelity signals, for comparing the first and second absolute values, and storing a largest of the first and second absolute values.

11. The system of claim 10, further comprising a plurality of slave receptors connected to said transmitter for receiving the multiplexed first frames.

12. A system for bidirectionally switching and time-multiplexed transmission of high-fidelity audio signals and control signals, comprising:

a transmitter and receiver for exchanging time-multiplexed high-fidelity audio signals and control signals; and control means for receiving the high-fidelity signals and for receiving the control signals to monitor in real time changes in parameters related to the high-fidelity signals and to control in real time a configuration of said transmitter by means of said control signals, said control means comprising an operator interface and data processing means connected to said receiver for processing and displaying in real time control and routing data blocks corresponding to transmission channels for the high-fidelity signals, and for controlling in real time modifications to a configuration of said transmitter in response to commands from said operator interface.

13. The system of claim 12, further comprising a plurality of slave receptors connected to said transmitter for receiving the multiplexed first frames.

* * * * *